US010900344B2

(12) United States Patent
Al-Hajri et al.

(10) Patent No.: US 10,900,344 B2
(45) Date of Patent: *Jan. 26, 2021

(54) DETERMINING WELLBORE LEAK CROSSFLOW RATE BETWEEN FORMATIONS IN AN INJECTION WELL

(71) Applicant: Saudi Arabian Oil Company, Dhahran (SA)

(72) Inventors: Nasser Mubarak Al-Hajri, Abqaiq (SA); Mohammed D. Al-Ajmi, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 544 days.

This patent is subject to a terminal disclaimer.

(21) Appl. No.: 15/805,813

(22) Filed: Nov. 7, 2017

(65) Prior Publication Data

US 2019/0136686 A1 May 9, 2019

(51) Int. Cl.

| | |
|---|---|
| ***E21B 47/00*** | (2012.01) |
| ***E21B 43/12*** | (2006.01) |
| *E21B 47/06* | (2012.01) |
| *E21B 47/10* | (2012.01) |
| *E21B 49/00* | (2006.01) |
| *E21B 41/00* | (2006.01) |
| *E21B 47/117* | (2012.01) |

(52) U.S. Cl.

CPC ..... *E21B 47/00* (2013.01); *E21B 43/12* (2013.01); *E21B 41/00* (2013.01); *E21B 47/06* (2013.01); *E21B 47/10* (2013.01); *E21B 47/117* (2020.05); *E21B 49/00* (2013.01)

(58) Field of Classification Search

None

See application file for complete search history.

(56) References Cited

U.S. PATENT DOCUMENTS

| | | | | |
|---|---|---|---|---|
| 7,089,167 | B2 | 8/2006 | Poe | |
| 7,369,979 | B1 | 5/2008 | Spivey | |
| 7,580,797 | B2 | 8/2009 | Akram et al. | |
| 8,781,747 | B2 | 7/2014 | Ziauddin | |
| 9,784,885 | B2 | 10/2017 | Al-Ajmi et al. | |
| 10,125,586 | B2 | 11/2018 | Balan | |
| 10,215,002 | B2 * | 2/2019 | Al-Hajri | E21B 43/00 |
| 2008/0210470 | A1 | 9/2008 | Stewart | |
| 2008/0257544 | A1 | 10/2008 | Thigpen et al. | |
| 2010/0147066 | A1 | 6/2010 | Ziauddin | |
| 2010/0307742 | A1 | 12/2010 | Ziauddin | |
| 2010/0307743 | A1 | 12/2010 | Ziuddin | |
| 2011/0229071 | A1 * | 9/2011 | Vincelette | E21B 43/2406 385/13 |

(Continued)

FOREIGN PATENT DOCUMENTS

| | | |
|---|---|---|
| WO | 2013006232 | 1/2013 |

OTHER PUBLICATIONS

International Search Report and Written Opinion of the International Searching Authority issued in International Application No. PCT/US2017/028284 dated Aug. 8, 2017; 11 pages.

(Continued)

*Primary Examiner* — Kibrom K Gebresilassie

(74) *Attorney, Agent, or Firm* — Fish & Richardson P.C.

(57) ABSTRACT

Techniques to determine wellbore leak crossflow rate between formations in an injection well are described. The techniques repurpose well performance principles to achieve the objective of cross flow rate quantification without the need to run a flowmeter.

20 Claims, 13 Drawing Sheets

(56) References Cited

U.S. PATENT DOCUMENTS

| | | | | |
|---|---|---|---|---|
| 2011/0308812 | A1 | 12/2011 | Bullen | |
| 2011/0320047 | A1 | 12/2011 | Stone | |
| 2012/0095733 | A1 | 4/2012 | Rossi | |
| 2013/0035920 | A1 | 2/2013 | Al-Shammari | |
| 2013/0116998 | A1 | 5/2013 | Shirzadi | |
| 2014/0366640 | A1* | 12/2014 | Sidhwa | G01F 1/56 73/861.12 |
| 2015/0039234 | A1 | 2/2015 | Abou-Sayed | |
| 2015/0378052 | A1* | 12/2015 | Al-Ajmi | G06F 17/10 703/2 |
| 2016/0208599 | A1* | 7/2016 | Rahman | E21B 49/008 |
| 2016/0282881 | A1 | 9/2016 | Filippov | |
| 2016/0319655 | A1* | 11/2016 | Awadh | E21B 44/005 |
| 2017/0321522 | A1 | 11/2017 | Nasser | |
| 2019/0136686 | A1* | 5/2019 | Al-Hajri | E21B 47/06 |

OTHER PUBLICATIONS

Al-Hajri et al., "Forecasting the Reliability of a Wastewater Disposal System and Predicting Future Corrective Actions Using Hydraulic Simulation," Society of Petroleum Engineers (SPE 177488), Abu Dhabi International Petroleum Exhibition and Conference, Jan. 1, 2015; 11 pages.

Al-Hajri et al., "Calculating Casing Leak Cross Flow Rate Using Surface Injection Data," (SPE 188107) Society of Petroleum Engineers, Jun. 1, 2017; 15 pages.

Craft et al., "Applied Petroleum Reservoir Engineering," Second Edition, Copyright 1991, 226 pages.

Economides et al., "Petroleum Production Systems," Second Edition, Copyright 2013, 60 pages.

Frooqnia, "Numerical Simulation and Interpretation of Borehole Fluid-Production Measurements," Ph.D. dissertation, Copyright 2014, 408 pages.

International Search Report and Written Opinion issued in International Application No. PCT/US2018/058449 dated Mar. 6, 2019, 15 pages.

GCC Examination Report in GCC Appln. No. GC 2018-36401, dated Mar. 19, 2020, 4 pages.

* cited by examiner

500

600

700

800

900

Actual injection well at normal injection conditions

Actual injection well at crossflow injecting conditions

Imaginary injection well at imaginary injection conditions

Imaginary production well at imaginary production condition

Actual injection well at crossflow shut-in conditions

DETERMINING WELLBORE LEAK CROSSFLOW RATE BETWEEN FORMATIONS IN AN INJECTION WELL

TECHNICAL FIELD

This specification relates to crossflow analysis in an injection well.

BACKGROUND

An injection well is used to flow fluid into a subterranean zone that includes a formation, a portion of a formation, or multiple formations, for example, sandstone, limestone or other formations. The injection fluid can be water, wastewater, brine, water mixed with chemicals, combinations of them or other fluids. Injection wells are sometimes used in hydrocarbon recovery. For example, fluid such as steam, carbon dioxide, water, or other fluid can be injected into a hydrocarbon reservoir to maintain reservoir pressure, or heat the hydrocarbon in the reservoir, thereby allowing the hydrocarbon to be recovered from the reservoir. Sometimes, a leak develops inside the injection well causing fluids to flow from a high pressure formation in the subterranean zone to a low pressure formation in another subterranean zone through the injection well, specifically, through the leak. Such leaks can affect an integrity of the injection wells, and, in turn, the hydrocarbon recovery from the hydrocarbon reservoir.

SUMMARY

This specification describes technologies relating to determining wellbore leak crossflow rate between formations in an injection well.

Certain aspects of the subject matter described here can be implemented as a method. During normal operation of an injection well formed in a subterranean zone, multiple bottomhole pressures at a bottom of the injection well are determined based on a respective multiple surface injection pressures at a surface of the injection well. Each surface injection pressure is a pressure in the injection well resulting from a respective injection flow rate at which injection fluid is flowed through the injection well from the surface toward the bottom. An injection well performance model is determined for the injection well based on the multiple bottomhole pressures and multiple injection flow rates. Each injection flow rate is caused by each surface injection pressure of the multiple surface injection pressures. The injection well is shut-in responsive to a subsurface leak which causes a crossflow from a high pressure region in the subterranean zone to a comparatively low pressure region in another subterranean zone through the injection well. After the shut-in, the shut-in injection well is modeled as an injection well having the injection well performance model determined during normal operation of the injection well. The shut-in injection well is modeled as a producing well having the injection well performance model determined during normal operation of the injection well. A crossflow rate in the injection well is determined at a location of the subsurface leak in the injection well based on the injection well performance model of the modeled injection well and the injection well performance model of the modeled producing well.

This, and other aspects, can include one or more of the following features. To model the shut-in injection well as the injection well having the injection well performance model determined during normal operation of the injection well, an injectivity index for the injection well is determined during normal operation of the injection well using the injection well performance model. The injectivity index is a ratio between an injection flow rate of the injection fluid into the injection well and a difference between a downhole injection pressure resulting from the injection flow rate and a static bottomhole reservoir pressure. The injectivity index for the injection well is assigned as the injectivity index for the producing well. To determine the injectivity index for the injection well during normal operation of the injection well using the injection well performance model, multiple injectivity indices are determined based on the multiple bottomhole pressures and multiple injection flow rates, and calibrated. To calibrate the multiple injectivity indices, a statistical regression analysis is performed on the multiple injectivity indices. To determine the injection well performance model for the injection well based on the multiple bottomhole pressures and the multiple injection flow rates, a curve for the injection well performance model is determined. The curve represents a bottomhole pressure and an injection flow rate of the injection fluid into the injection well at the surface of the injection well. The bottomhole pressure in the curve is determined using the following equation:

$$Pdownhole\ inj. = P_{WH_{inj}} + \frac{\rho_w \sin\emptyset \times D}{144} - \left[\frac{f\rho_w Q^2}{14.79 g_c d^5}\right].$$

$P_{WH_{inj.}}$ is the surface injection pressure measured for the injection flow rate, $\rho_w$ is the density of the injection fluid, Ø is a deviation angle of the injection well relative to a vertical axis, f is a dimensionless friction factor, $g_c$ is acceleration due to gravity, and d is an inside diameter of the injection well. The injection flow rate in the curve is determined using the following equation: Q=II (Pdownhole inj.−Pr). II is an injectivity index of the injection well and Pr is a static bottomhole reservoir pressure of the injection well before the injection well shut-in. To model the shut-in injection well as the injection well having the injection well performance model determined during normal operation of the injection well, a bottomhole pressure of the modeled shut-in injection well is assigned to be the same as a bottomhole pressure of the injection well measured during normal operation. To determine the crossflow rate in the injection well at the location of the subsurface leak in the injection well based on the injection well performance model of the modeled injection well and the injection well performance model of the modeled producing well, the location of the subsurface leak in the injection well is assigned as a top node of the modeled shut-in producing well. A production flow rate for the modeled shut-in producing well at each bottomhole pressure of the multiple bottomhole pressures based on which the injection well performance model was determined is determined. The production flow rate is determined using the following equation: Q=PI (Pr−Pwf). Q is the production flow rate, PI is a productivity index of the producing well, Pr is a static bottomhole reservoir pressure of the injection well during normal operation and Pwf is a flowing bottomhole reservoir pressure of the modeled shut-in producing well at a selected node, being the subsurface leak depth, after the injection well shut-in responsive to a leak. The productivity index is assigned the injectivity index of the injection well during normal operation. The injection fluid can be water.

Certain aspects of the subject matter described here can be implemented as a computer-readable medium (transitory or non-transitory) storing computer instructions executable by one or more processors to perform operations described here. Certain aspects of the subject matter described here can be implemented as a system that includes one or more processors and a computer-readable medium (transitory or non-transitory) storing computer instructions executable by the one or more processors to perform operations described here.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
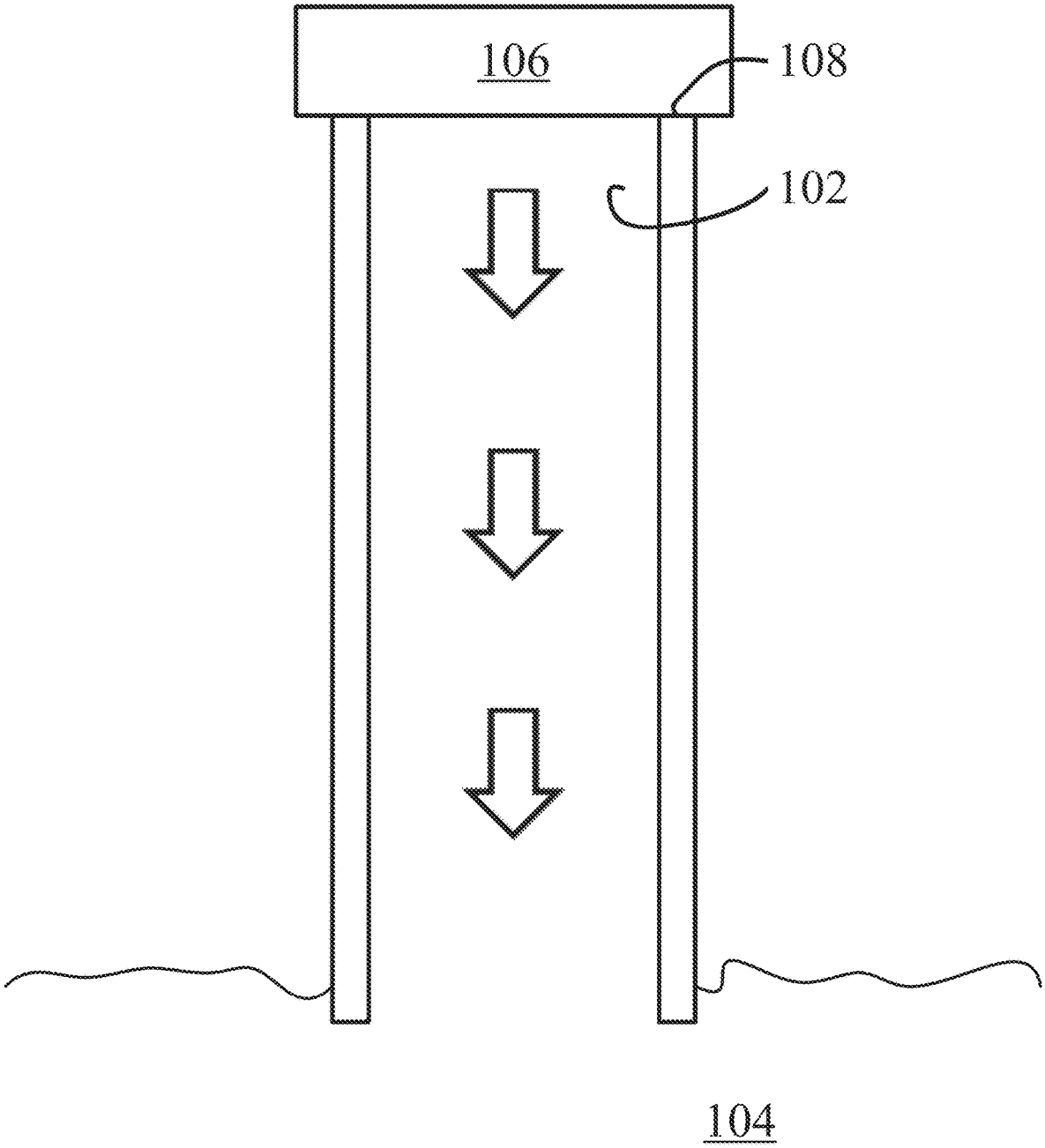
FIG. 1 is a schematic diagram of an injection well.

This specification describes determining the crossflow rate between two formations resulting from a downhole leak in a water well. Well integrity monitoring is an important aspect of safe well production or injection operations. Certain well integrity monitoring systems include wellhead tree valve tests, lending base inspections, annuli surveys, and temperature and corrosion logging. When an integrity issue arises, well prepared operations are performed using a workover rig to restore well integrity. Wells under leak crossflow are classified as being in a well control situation. One step of proper well integrity diagnostics includes quantifying leak crossflow rates to plan for crossflow isolation and subsequent well workover to secure such wells. One technique to quantify crossflow rate includes running spinners (for example, flow meters) by wireline, coiled tubing or other conveyance methods to a subsurface location of the leak, and identifying both the crossflow rate and a direction of the crossflow using the spinners. However, such measurements may not be operationally or economically viable at times. This specification describes determining the crossflow rate without implementing such spinners, but instead using surface data measured during normal operation of the well. By implementing the techniques described in this specification, well securement design can be optimized while minimizing well interventions, cost associated with running a spinner downhole can be minimized or avoided and potential mechanical damage resulting from well intervention via a spinner can also be minimized or avoided.

As described later, the crossflow rate between two formations in a leaking injection well is determined using well injection and well shut-in data prior to and post the leak without the need for a spinner or flow meter. To do so, well performance modeling and nodal analysis are implemented on the injection well. Well performance modeling is a consistently dependable tool in establishing well injection or production behavior. Well performance modeling is particularly effective in water wells due to the single phase flow characteristic of water injectors that facilitate accurate computation of dynamic well parameters. Well performance modeling using nodal analysis is implemented by dividing the well system into different segments based on selected nodes.

In some implementations, crossflow rate between two formations resulting from a downhole leak in a water well is calculated. To do so, an actual injection well performance model is generated using pre-leak injection data. The data includes physical dimensions of the injection well, most recent static bottom-hole pressure, and injection pressures and rates. The generated performance model is then calibrated using surface injection pressures and rates data to generate an injectivity index of the actual injection well. Then, an imaginary injection well model is generated by mimicking the flow characteristics and properties of the actual water injector to simulate leak crossflow at flowing (that is, injection) conditions. The imaginary injection well is assumed to have the same reservoir pressure and injectivity index as the actual injection well. The imaginary injection well model has a top node selected to be the leak point. Performance curves are generated at different node pressures for the imaginary injection well model. The performance model for the imaginary injection well is plotted showing injection pressure v/s flow rate. A performance model of the leaking formation using post-leak injection data is generated by calculating flow injection pressures ($P_{wf1}$) at the leak depth based on surface injection pressures and rates collected after the leak has developed in the actual well. Using the flowing injection pressure at the leak depth and the imaginary injection well model, the injection rate ($Q_{df}$) that goes into the downhole formation is determined. Using $Q_{df}$ and the total injection rate ($Q_t$), the flow rate into the leaking formation ($Q_1$) is determined. A performance model of the leaking formation is generated by plotting the flow injection pressures ($P_{wf1}$) versus the flow rate into the leaking formation ($Q_1$). An imaginary production well model is generated by mimicking the flow characteristics and properties of the actual water injector to simulate leak crossflow at shut-in conditions. The imaginary production well is modeled to have the same reservoir pressure of the actual injection well. The productivity index of the imaginary production well is assumed to be equal to the injectivity index of the actual injection well. The imaginary production flowrates from the downhole formation into the leaking formation ($Q_{ip}$) are generated. The imaginary production well's system node is selected to be at the leak point. The flow injection pressures ($P_{wf1}$) is then plotted against the flowrates from the downhole formation into the leaking formation ($Q_{ip}$). The intersection of the $P_{wf1}$ v/s $Q_1$ plot and the $P_{wf1}$ v/s $Q_{ip}$ plot is the crossflow rate into the leak.

Implementations of the techniques described here can provide the ability to design a well control method without running a flow meter survey when a casing leak develops in tubing-less water injectors. Implementations can further allow repurposing conventional well performance modeling principles to calculate the cross flow rate from pre-leak and post-leak surface injection data and previous knowledge of the leak depth. Implementations of the techniques described here can reduce the risks associated with live-well intervention in addition to eliminating the costs associated with the intervention.

Figure 3:
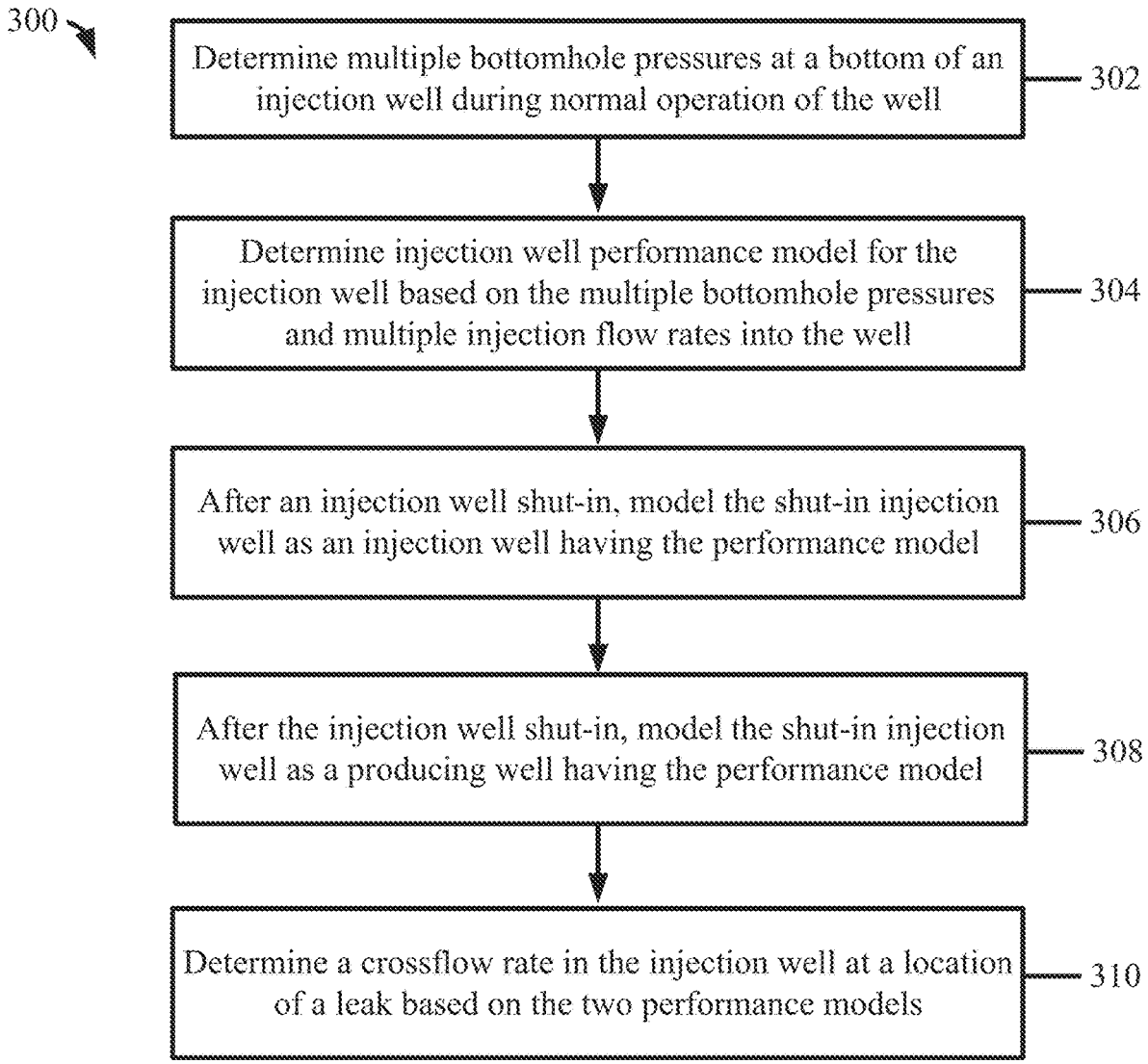
FIG. 3 is a flowchart of an example process of determining a crossflow rate in the injection well at a location of a leak.

FIG. 1 is a schematic diagram of an injection well 102. The injection well 102 is formed from a surface through a subterranean zone to extend into a formation 104. A wellhead 106 is positioned at the surface of the injection well 102. During normal operation, injection fluid (for example, water or other fluid) is flowed from the surface through the injection well 102 to the formation 104. During normal operation, the injection well performance model for the injection well 102 is generated to relate injection flow rates at which the injection fluid is flowed into the injection well 102 with the bottomhole flowing pressure of the injection well 102. The processes for determining the injection well performance model are described with reference to FIG. 3, which is an example process 300 of determining a crossflow rate in the injection well at a location of a leak.

At 302, multiple bottom hole pressures at a bottom of the injection well 102 are determined based on the respective multiple surface injection pressures at the surface of the injection well 102. Each surface injection pressure is a pressure in the injection well resulting from a respective injection flow rate at which the injection fluid is flowed through the injection well 102 from the surface towards the bottom.

In some implementations, the injection flow rates can be determined using an orifice plate. The orifice plate is positioned in a surface flowline connected to wellhead 106 of the injection well 102 and is used to measure injection data, which includes injection fluid flow rate and injection wellhead pressure at the surface of the injection well 102. For example the volumetric injection fluid flow rate into the injection well at the surface can be a pressure differential upstream and downstream of the orifice plate using Equation 1.

$$Q = \frac{22800 d_2^2}{\sqrt{1-\left(\frac{d_2^4}{d_1}\right)}}\sqrt{\frac{(P_1 - P_2)}{\rho_w}} \quad \text{(Equation 1)}$$

In Equation 1, Q is the volumetric flow rate (for example, in barrels (bbls) per day), $d_1$ is an inner diameter (for example, in inches) of a pipe connected to wellhead 106 of the injection well 102 through which the injection fluid flows, $d_2$ is an orifice diameter (for example, in inches) of an orifice in the orifice plate, $P_1$ is an injection fluid pressure (for example, in pounds per square inch (psi)) upstream of the orifice plate, $P_2$ is an injection fluid pressure (for example, in psi) downstream of the orifice plate, and $\rho_w$ is the density of the injection fluid (for example, in pounds-mass per cubic feet). The injection fluid pressures upstream and downstream of the orifice plate can be measured using one or more pressure sensors installed at one or more appropriate locations, respectively, in the injection well flowline 102.

The injection wellhead pressure is measured using a pressure sensor, for example, a pressure gauge or other pressure sensor, installed at the wellhead 106. A quantity and a flow rate of the injection fluid through the injection well 102 can be varied, for example, by operating the injection fluid pumps at different capacities. For each quantity, a respective injection wellhead pressure can be measured and a respective volumetric injection fluid flow rate can be calculated using Equation 1. The measured injection wellhead pressures and the calculated volumetric injection fluid flow rates can then be used to determine bottomhole pressures at the bottom of the injection well 102 as described later.

At 304, injection well performance model for the injection well is determined based on the multiple bottomhole pressures and multiple injection flow rates into the well. The multiple bottom hole pressures at the bottom of the injection well are determined using Equations 2 and 3.

$$P_{Downhole_{inj}} = P_{WH_{inj}} + \Delta P_g - \Delta P_f \quad \text{(Equation 2)}$$

$$P_{Downhole_{inj}} = P_{WH_{inj}} + \frac{\rho_w \sin\phi \times D}{144} - \left[\frac{f \rho_w Q^2}{14.79\ g_c\ d^5}\right] \quad \text{(Equation 3)}$$

In Equation 2, $P_{Downhole_{inj}}$ is the bottom hole injection pressure (for example, in psi), $P_{wH_{inj}}$ is the wellhead injection pressure (for example, in psi), $\Delta P_g$ is the gravitational delta pressure (for example, in psi) and $\Delta P_f$ is the frictional delta pressure (for example, in psi). In Equation 3, the wellhead injection pressure is measured and the gravitational pressure exerted by the injection water is represented by the formula $$\frac{\rho_w \sin\phi \times D}{144},$$

in which $\rho_w$ is the density of the injection fluid (for example, water or other single phase fluid). The angle $\varphi$ is a wellbore deviation angle measured with reference to the vertical axis and D is a depth of the injection well (for example, in feet). Also, in Equation 3, the frictional delta pressure is measured using the formula $$\frac{f \rho_w Q^2}{14.79\ g_c\ d^5},$$

where f is a dimensionless fiction factor, $g_c$ is acceleration due to gravity (32.2 ft/sec) and d is an inside diameter of the pipe in the injection well 102 through which the injection fluid flows.

In this manner, the injection well performance model of the injection well 102 is determined during normal operation of the injection well 102 to relate the volumetric injection flow rate (Q) and the bottom hole flowing pressure (P) at the bottom of the injection well 102. The injection well performance model describes the subsurface fluid flow of water into the formation 104 and the corresponding injectivity index. By varying the volumetric injection flow rate, different bottom hole flowing pressures can be calculated, and a curve for the injection well performance model generated for the injection well 102 can be plotted using volumetric injection flow rate versus bottom hole flowing pressures.

To model the shut-in injection well as the imaginary producing well having the injection well performance model determined during normal operation of the injection well 102, an injectivity index is determined for the injection well 102 using Equation 4.

$$Q=II(P_{Downhole_{inj}}-P_r) \quad \text{(Equation 4)}$$

In Equation 4, Q is the volumetric flow rate (for example, in barrels (bbls) per day) determined using Equation 1, $P_{Downhole_{inj}}$ is the bottom hole injection pressure (for example, in psi) determined using Equations 2 and 3, and $P_r$ is the static bottom hole (reservoir) pressure measured before the injection well 102 was shut-in.

Figure 5:
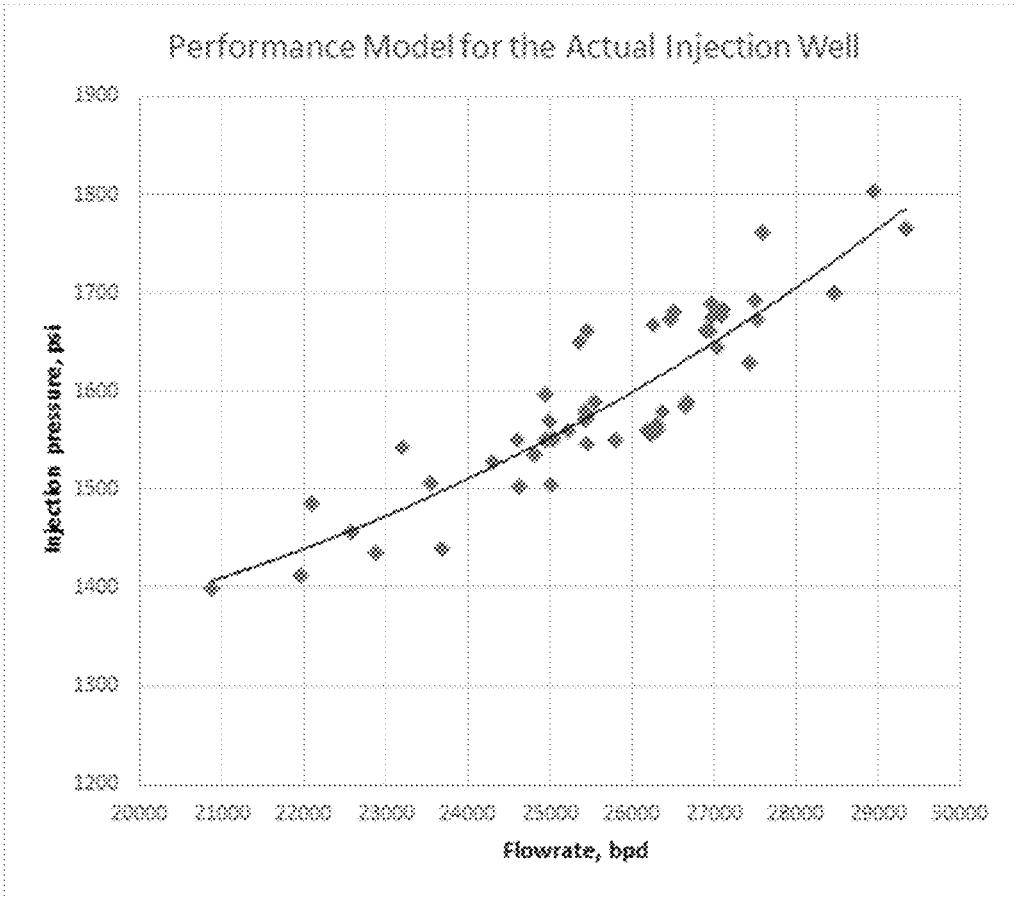
FIG. 5 is a plot showing a performance model of an actual injection well.

The injectivity index is a ratio between an injection flow rate of the injection fluid into the injection well and a difference between a downhole injection pressure resulting from the injection flow rate and a static bottom hole reservoir pressure. Injectivity indices are periodically calculated for the injection well 102 during normal operation from pressure fall off measurements. Over time, a bottom hole pressure resulting from a surface injection pressure can vary for the same well, for example, due to continuous application of pressure through the well. FIG. 5 is a plot 500 showing a performance model of an actual injection well. The X-axis of plot 500 is flowrate in barrels per day, and the Y-axis of plot 500 is injection pressure in pounds per square inch (psi). The plot relates the surface injection pressure and surface injection fluid rate that are directly proportional to each other. Knowledge of this relationship, between injection pressure and fluid flow rate assists in determining the injectivity index of an injection well. In some implementations, calibration operations (described later) can be implemented to calibrate the injection well performance model.

Figure 2A:
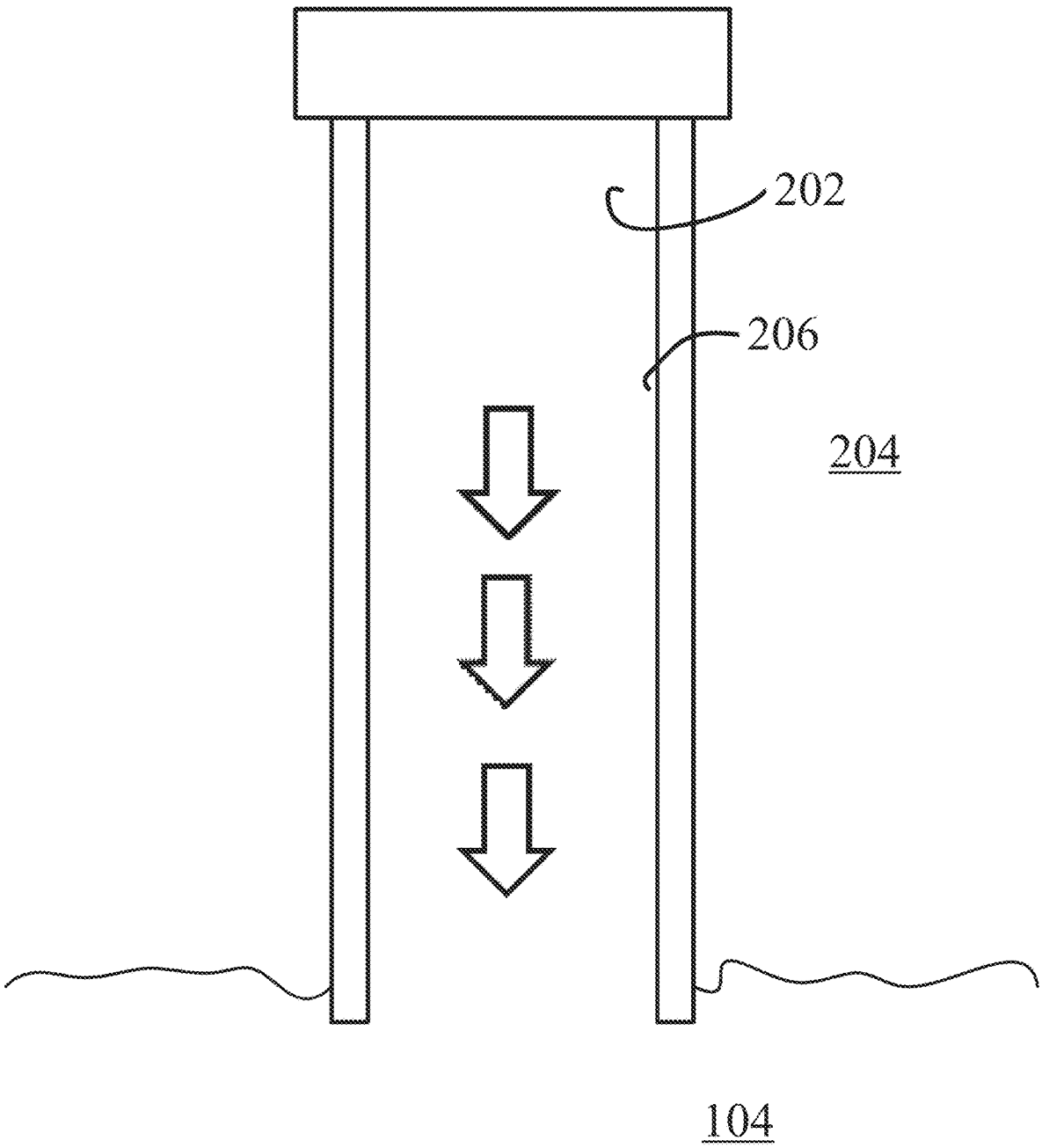
FIG. 2A is a schematic diagram of an imaginary injection well with a leak.

At 306, after an injection well shut-in, the shut-in injection well is modeled as an injection well having the injection well performance model of the injection well determined as described earlier. To do so, an injection well mimicking the flow characteristics and properties of the actual water injector is modeled (for example, computationally modeled) to simulate leak cross flow at flowing (injecting) conditions. FIG. 2A is a schematic diagram of an imaginary injection well 202 with a leak in the injection well 102 which causes a crossflow from a high-pressure region (for example, the formation 104) to a comparatively low-pressure region in the subterranean zone (for example, formation 204) through the injection well 102. The subsurface location of the leak is assigned as a top node 206 of the imaginary injection well. In other words, the imaginary injection well is considered as having the same physical dimension of the injection well 102 and to have an injection wellhead at the leak depth and that the total depth of the well is from the leak depth to the formation 104. The location of the leak can be identified, for example, by lowering a mechanical drifting tool conveyed via a wireline intervention into the shut-in injection well 102. In addition, it is assumed that the fluid being injected into the well is the injection fluid, that is, water or other single phase fluid flowing at a steady state from the high pressure formation 104 to the low pressure formation 204.

Figure 6:
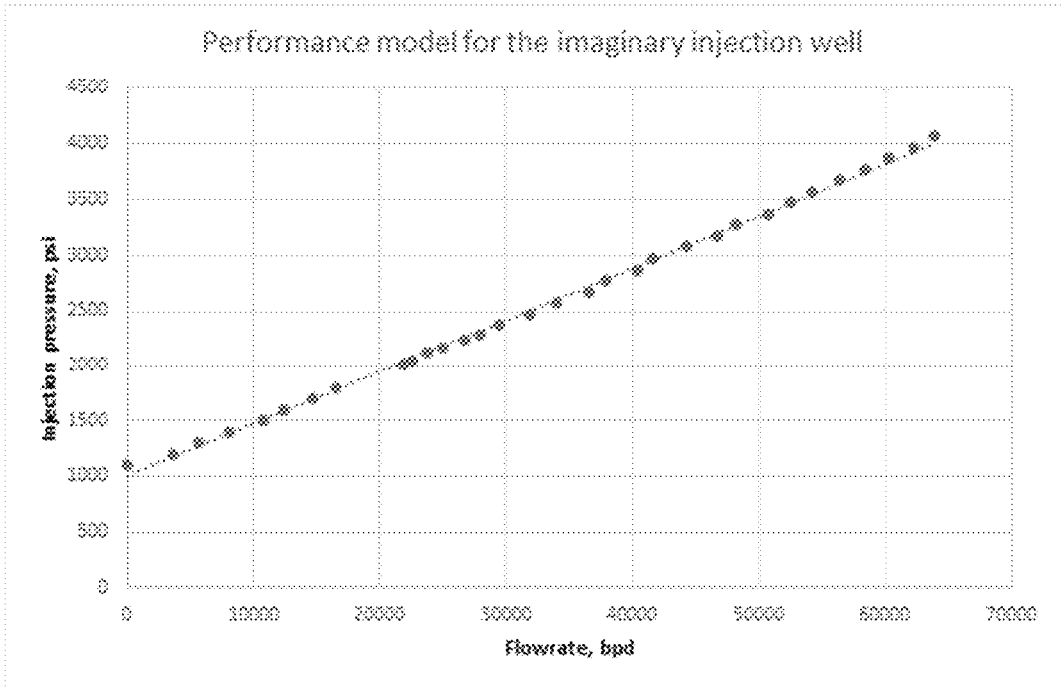
FIG. 6 is a plot showing a performance model of an imaginary injection well.

As described above, the imaginary injection well is assigned the same reservoir pressure and injectivity index of the actual injection well. The imaginary injection well model has a top node selected to be at the leak point and performance curves are generated at different system's node pressures. Equations 3 and 4 are used for this modeling. FIG. 6 is a plot 600 showing a performance model of an imaginary injection well. The X-axis of plot 600 is flowrate in barrels per day, and the Y-axis of plot 600 is injection pressure in pounds per square inch (psi). The plot relates the injection pressure and injection fluid rate that are directly proportional to each other. Knowledge of this relationship, between injection pressure and fluid flow rate assists in determining the injectivity index of an injection well.

Figure 2B:
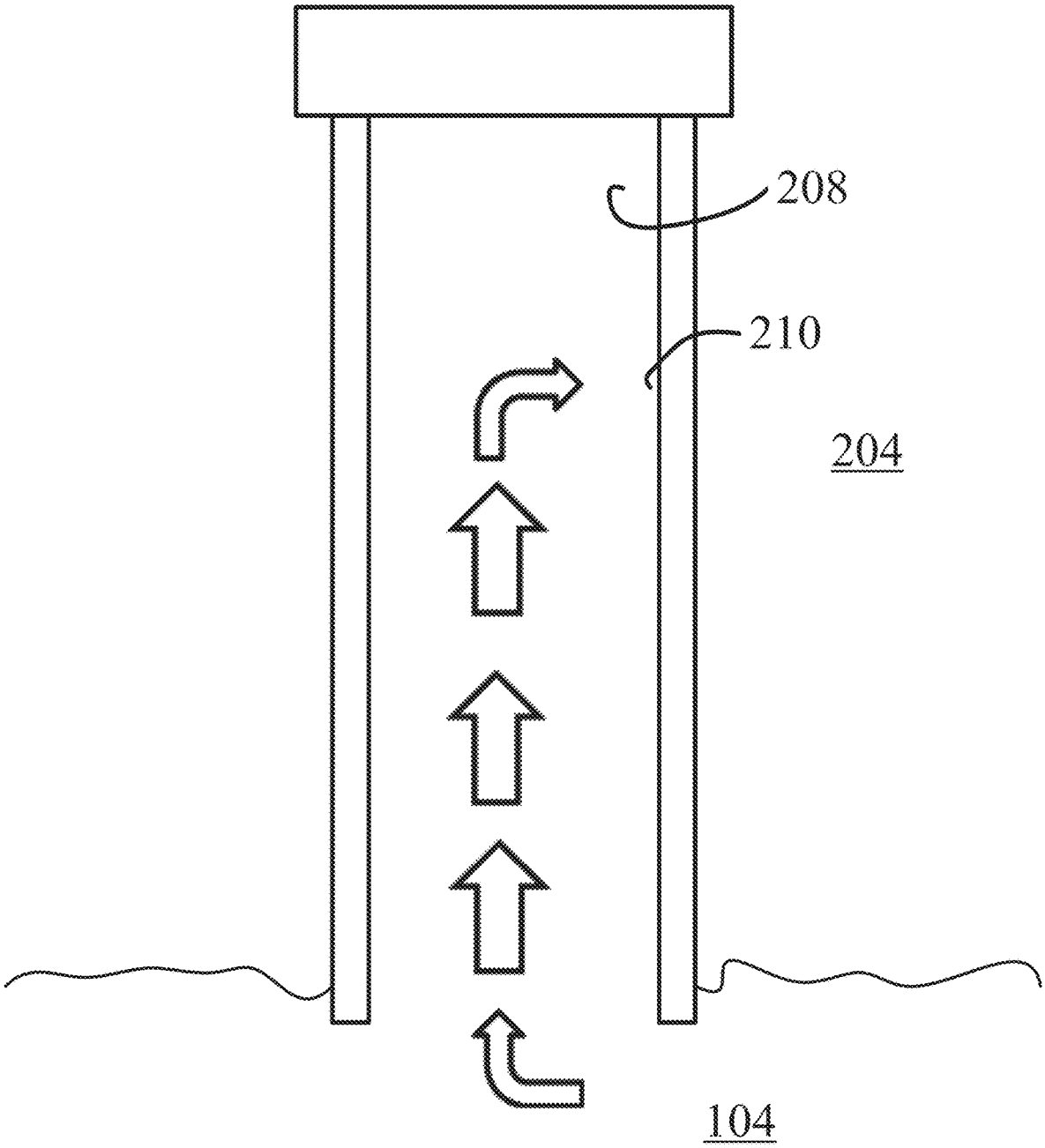
FIG. 2B is a schematic diagram of an imaginary producing well with a leak.

At 308, after an injection well shut-in, the shut-in injection well is modeled as a production well having the same well performance model of the injection well determined as described earlier. To do so, a production well mimicking the flow characteristics and properties of the actual water injector is modeled (for example, computationally modeled) to simulate leak cross flow at flowing (injecting) conditions. FIG. 2B is a schematic diagram of an imaginary production well 208 with a leak in the injection well 102 which causes a crossflow from a high-pressure region (for example, the formation 104) to a comparatively low-pressure region in the subterranean zone (for example, formation 204) through the injection well 102. The subsurface location of the leak is assigned as a top node 210 of the imaginary production well. In other words, the imaginary production well is considered as having the same physical dimension of the injection well 102 and to have an injection wellhead at the leak depth and that the total depth of the well is from the leak depth to the formation 104. The location of the leak can be identified, for example, by lowering a mechanical drifting tool conveyed via a wireline intervention into the shut-in injection well 102. In addition, it is assumed that the fluid being produced from the well is the injection fluid, that is, water or other single phase fluid flowing at a steady state from the high pressure formation 104 to the low pressure formation 204.

As described above, the imaginary production well is assigned the same reservoir pressure and injectivity index of the actual injection well. The imaginary injection well model has a top node selected to be at the leak point and performance curves are generated at different system's node pressures. A new curve is determined for the imaginary producing well using the productivity index assigned to the imaginary producing well. As described earlier, the top node for the imaginary producing well model is assigned as the subsurface location of the leak. The crossflow rate in the injection well 102 at the subsurface location is then determined using Equation 5.

$$Q=PI(P_r-P_{Downhole_{inj}}) \quad \text{(Equation 5)}$$

In Equation 5, Q is the production flow rate (that is, the crossflow rate through the subsurface location of the leak), $P_r$ is the static bottom hole (reservoir) pressure measured before the injection well 102 was shut-in and $P_{Downhole_{inj}}$ is the bottom hole injection pressure (for example, in psi) of the leak formation for a well having the well parameters (that is, depth, internal diameter) of the imaginary producing well. In particular, because a leak depth of the imaginary producing well is the same as a depth of the injection well 102, the bottom hole injection pressure determined for the imaginary producing well will be the same as that determined for the injection well 102. Consequently, the crossflow rate through the subsurface location of the leak will also be different from the volumetric flowrate at a surface of the injection well 102. FIG. 6 is a plot 600 showing a performance model of an imaginary injection well. The X-axis of plot 600 is flowrate in barrels per day, and the Y-axis of plot 600 is injection pressure in pounds per square inch (psi).

Figure 4A:
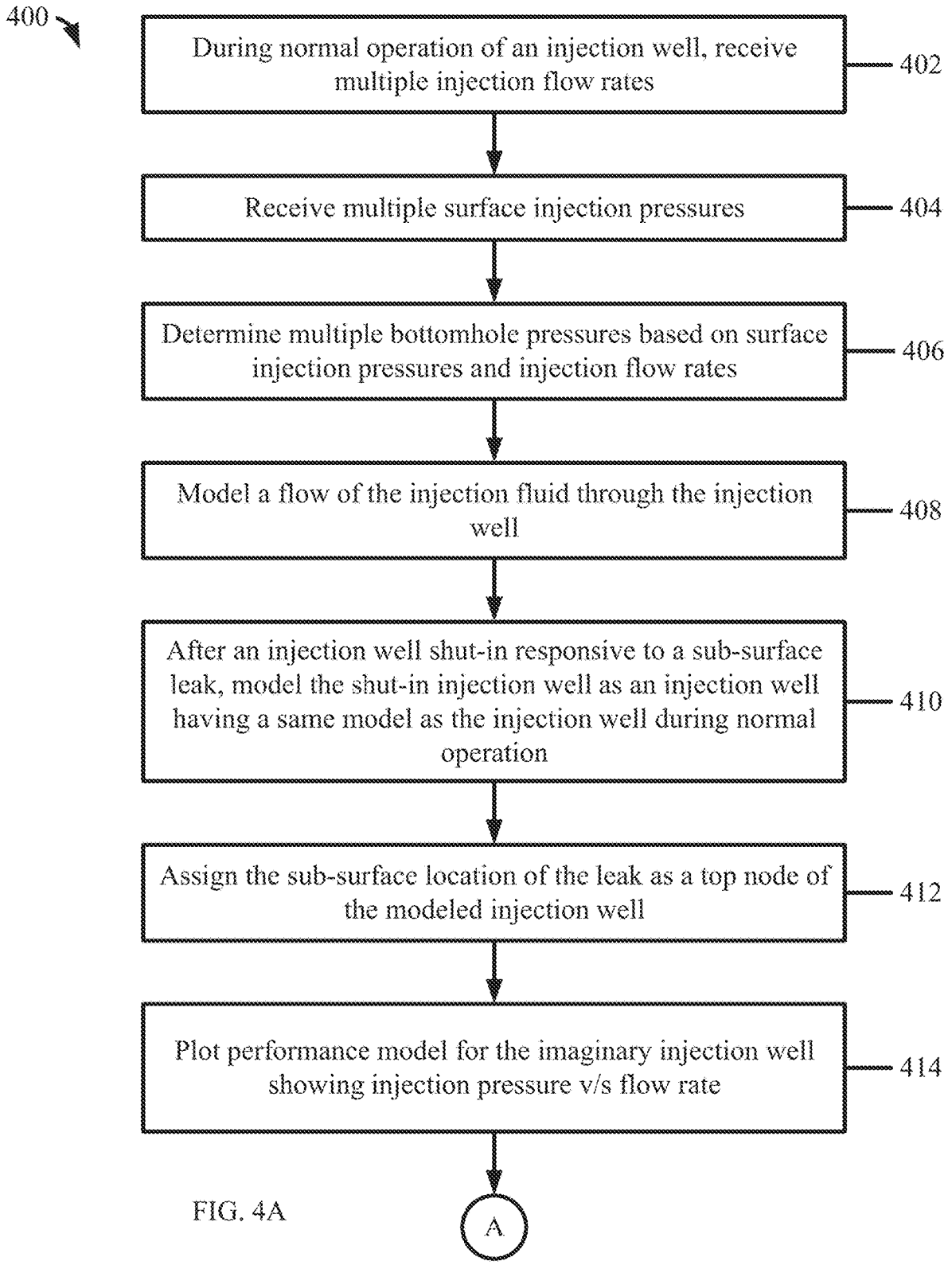
FIGS. 4A and 4B are flowcharts of an example process of modeling a leak in an injection well.
Figure 4B:
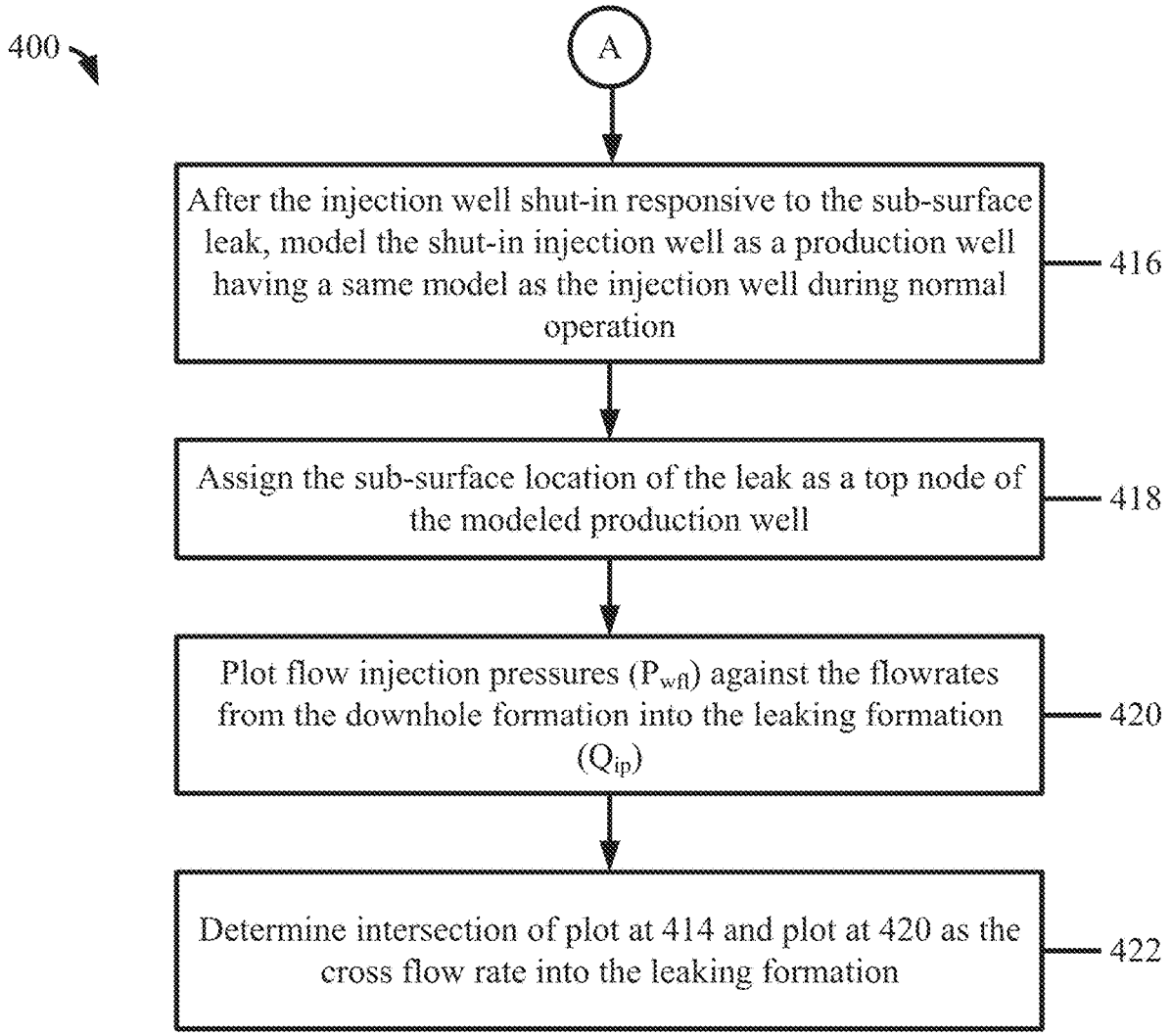

FIGS. 4A and 4B are flowcharts of an example process of modeling a leak in an injection well, for example, the injection well 102. At 402, during normal operation of an injection well, receive multiple injection flow rates are received. At 404, multiple surface injection pressures are received. At 406, multiple bottomhole pressures are determined based on surface injection pressures and injection flow rates. At 408, a flow of the injection fluid through the injection well is modeled. The process steps 402, 404, 406 and 408 are implemented in a manner substantially similar to the process steps 302 and 304 described earlier with reference to the flowchart 300 of FIG. 3.

At 410, after an injection well shut-in responsive to a sub-surface leak, the shut-in injection well is modeled as an injection well having a same model as the injection well during normal operation. To do so, at 412, the sub-surface location of the leak is assigned as a top node of the modeled injection well. The process steps 410 and 412 are implemented in a manner substantially similar to the process step 306 described earlier with reference to the flowchart 300 of FIG. 3. The output of process step 412 is the plot 600 described earlier with reference to FIG. 6.

At 414, the performance model for the imaginary injection well is plotted showing injection pressure v/s flow rate. The performance model is generated using post-leak injection data. Surface injection pressures and rates collected after the leak has developed in the actual well injection well are used to calculate the flowing injection pressures at the leak depth ($P_{wfL}$). The total injection rate ($Q_t$) measured at surface has two portions: one portion goes into the leaking formation ($Q_L$) and another goes into the downhole formation ($Q_{DF}$). Then, the imaginary injection well model is used to calculate $Q_{DF}$ by utilizing $P_{wfL}$ as the wellhead pressure of the imaginary injection well. Using the conservation of mass principle and assuming incompressible fluid (i.e. constant density), $Q_L$ is quantified using Equation 6.

$$Q_L = Q_T - Q_{DF} \quad \text{(Equation 6)}$$

Figure 7:
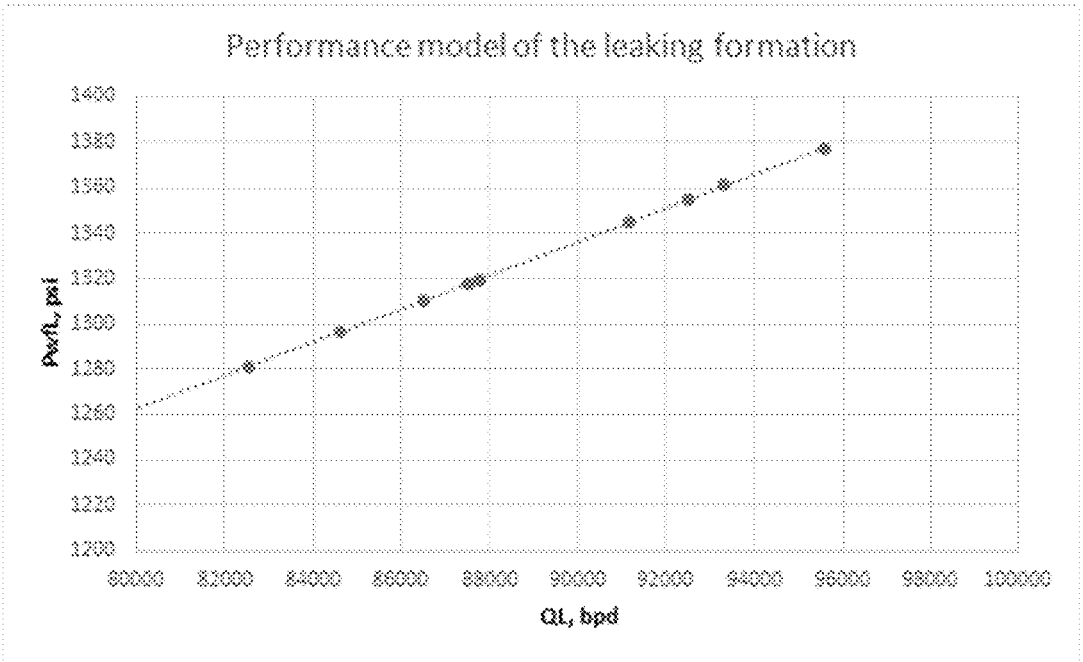
FIG. 7 is a plot showing a performance model of the leaking formation.

After that, $P_{wfL}$ is plotted versus $Q_L$ to generate the performance model of the leaking formation. The output of process step 414 is the plot 700 (FIG. 7). The X-axis shows the volumetric flow rate entering the leaking formation ($Q_1$) in barrels per day, and the Y-axis shows pressures at the leak depth ($P_{wf1}$).

Figure 8:
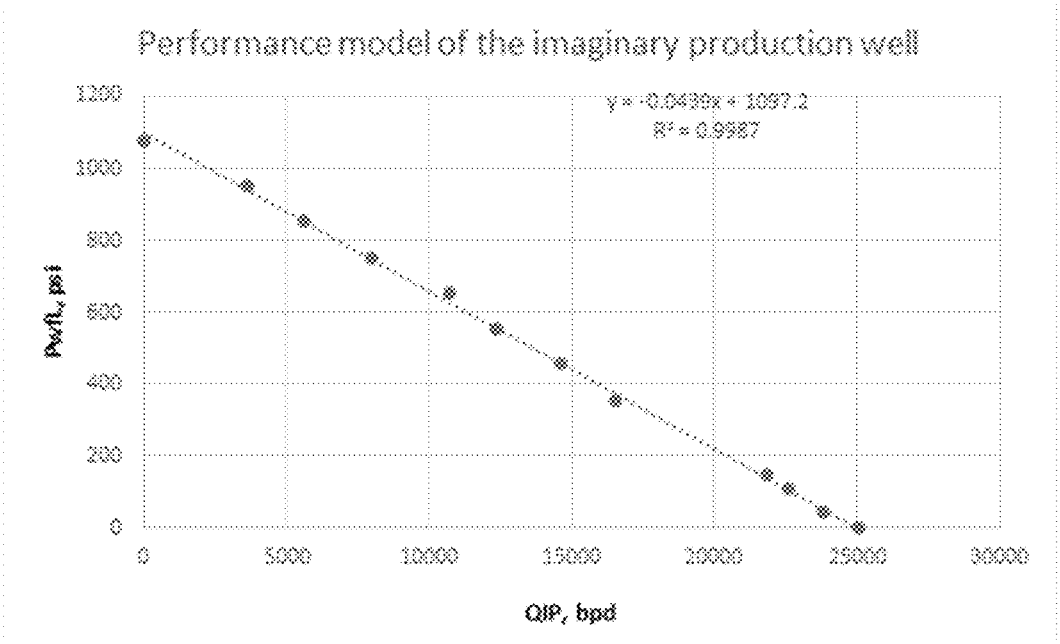
FIG. 8 is a plot showing a performance model of the imaginary production well.

At 416, after the injection well shut-in responsive to the sub-surface leak, the shut-in injection well is modeled as a production well having a same model as the injection well during normal operation. To do so, at 418, the sub-surface location of the leak is assigned as a top node of the modeled production well. At 420, flow injection pressures ($P_{wf1}$) at plotted against the flowrates from the downhole formation into the leaking formation ($Q_{ip}$) as shown, for example, in plot 800 (FIG. 8).

Figure 9:
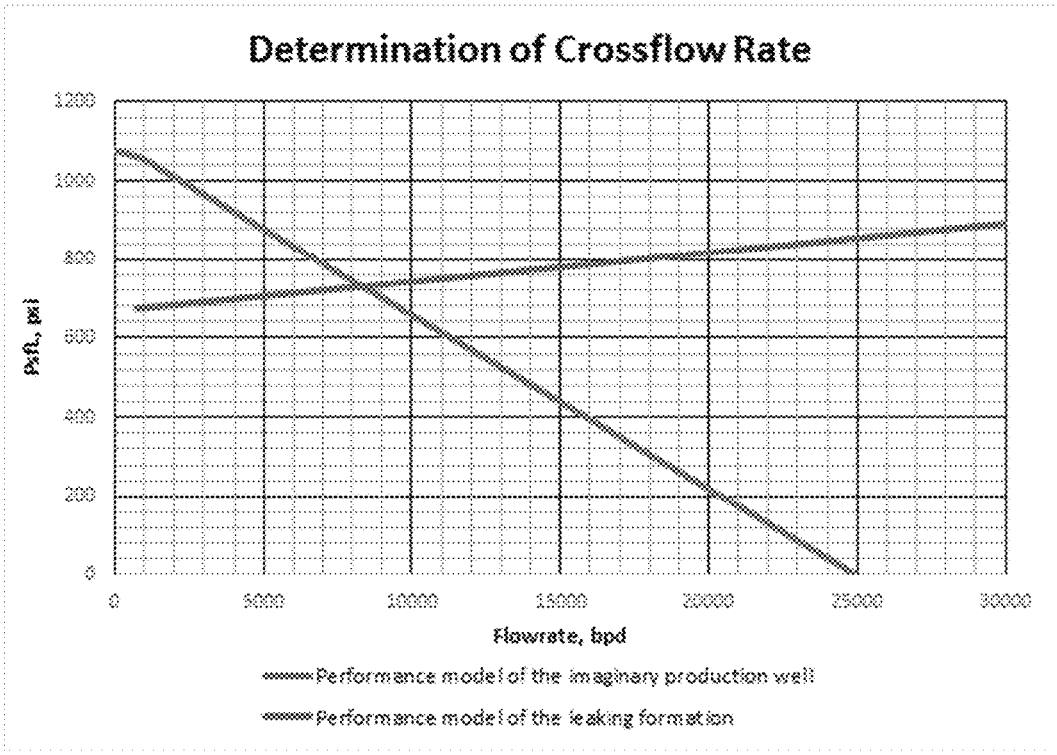
FIG. 9 is a plot showing determination of the cross flow rate.

At 422, an intersection of the plot determined at 414 (for example, plot 700) and the plot determined at 420 (for example, plot 800) is determined as the cross flow rate into the leaking formation. FIG. 9 is a plot 900 showing determination of the cross flow rate.

Figures 10A, 10B, 10C, 10D, 10E:
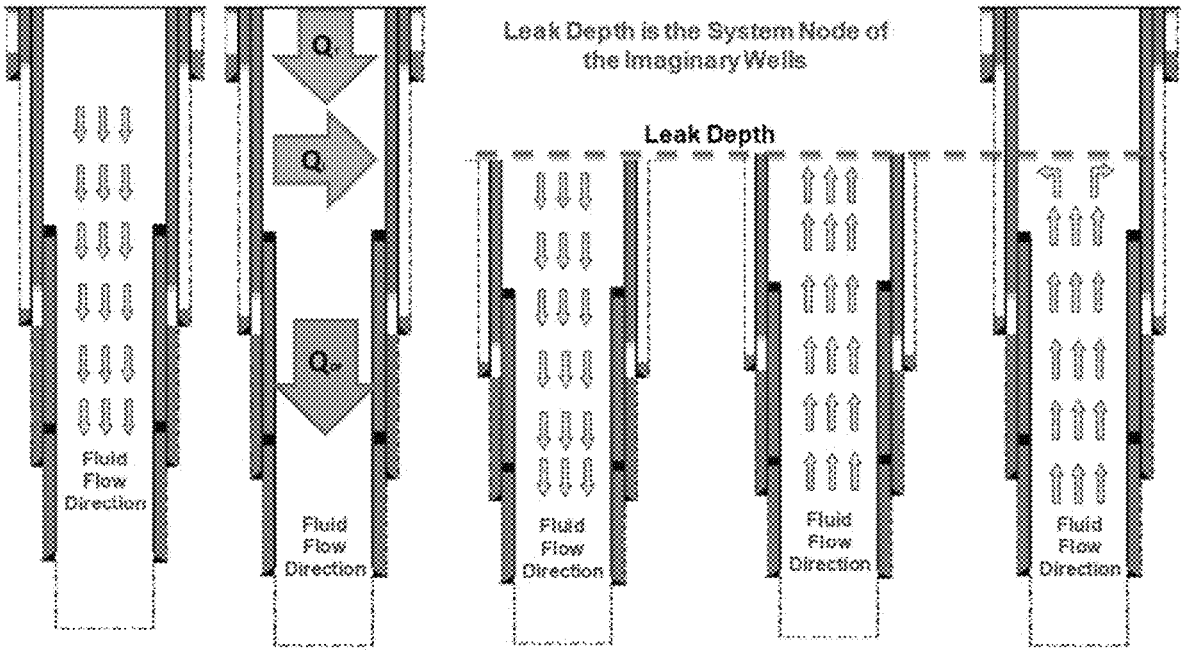
FIGS. 10A-10E are schematic diagrams of actual and imaginary injection wells to model a leak.

The techniques described above are summarized in the following text with reference to FIGS. 10A-10E, which are schematics of actual and imaginary injection wells to model a leak. FIG. 10A is a schematic of an actual injection well at normal injection conditions. FIG. 10B is a schematic of the injection well at crossflow injection conditions. FIG. 10C is a schematic of an imaginary injection well at imaginary injection conditions. FIG. 10D is a schematic of an imaginary production well at imaginary production conditions. FIG. 10E is a schematic of an actual injection well at crossflow shut-in conditions. The surface of the imaginary wells (FIGS. 10C, 10D) is the same as the leak depth of the cross-flow in the actual injection well (FIG. 10E). The leak can be modeled by implementing the following steps.

First, the actual injection well performance model can be generated using pre-leak injection data obtained by implementing measurements described earlier in the actual injection well schematically shown in FIG. 10A. The actual injection well physical dimensions, most recent static bottomhole pressure, and injection pressures and rates are all used to build the performance model of the downhole formation using Equations 3 and 4. The generated performance model is then calibrated using the wellhead (surface) injection pressures and rates data. The output of this modeling will generate the injectivity index of the actual injection well.

Second, an imaginary injection well model (FIG. 10C) is generated. The imaginary injection well mimics the flow characteristics and properties of the actual water injector to simulate leak cross flow at flowing (injecting) conditions. The imaginary injection well has the same reservoir pressure and injectivity index of the actual injection well. The imaginary injection well model has a top node selected to be at the leak point and performance curves are generated at different systems' node pressures. Equations 3 and 4 apply to this modeling.

Third, the performance model of the leaking formation is generated using post-leak injection data (FIG. 10B). Surface injection pressures and rates collected after the leak has developed in the actual well injection well are used to calculate the flowing injection pressures at the leak depth ($P_{wfL}$). The total injection rate ($Q_t$) measured at surface has two portions: one portion goes into the leaking formation ($Q_L$) and another goes into the downhole formation ($Q_{DF}$). Then, the imaginary well model is used to calculate the $Q_{DF}$ by utilizing $P_{wfL}$ as the wellhead pressure of the imaginary injection well. Using the conservation of mass principle and assuming incompressible fluid (i.e. constant density), $Q_L$ is quantified using Equation 6. After that, $P_{wfL}$ is plotted versus $Q_L$ to generate the performance model of the leaking formation.

Fourth, an imaginary production well model (FIG. 10D) is generated. A production well that mimics the flow characteristics and properties of the actual water injector is envisioned to simulate leak cross flow at shut-in conditions. The imaginary production well has the same reservoir pressure of the actual injection well and the productivity index of the imaginary production well is assumed to be equal to the injectivity index of the actual injection well. The imaginary production flowrates from the downhole formation into the leaking formation are called QIP and are generated from Equations 3 and 5. The imaginary production well's system node is selected to be at the leak point and $P_{wfl}$ is plotted against $O_{IP}$. The intersection of the two curves generated from the third and fourth steps are plotted together, with the intersection point being the operating system node pressure and rates that corresponds to the cross flow rate at shut-in conditions (FIG. 10E).

Figure 11:
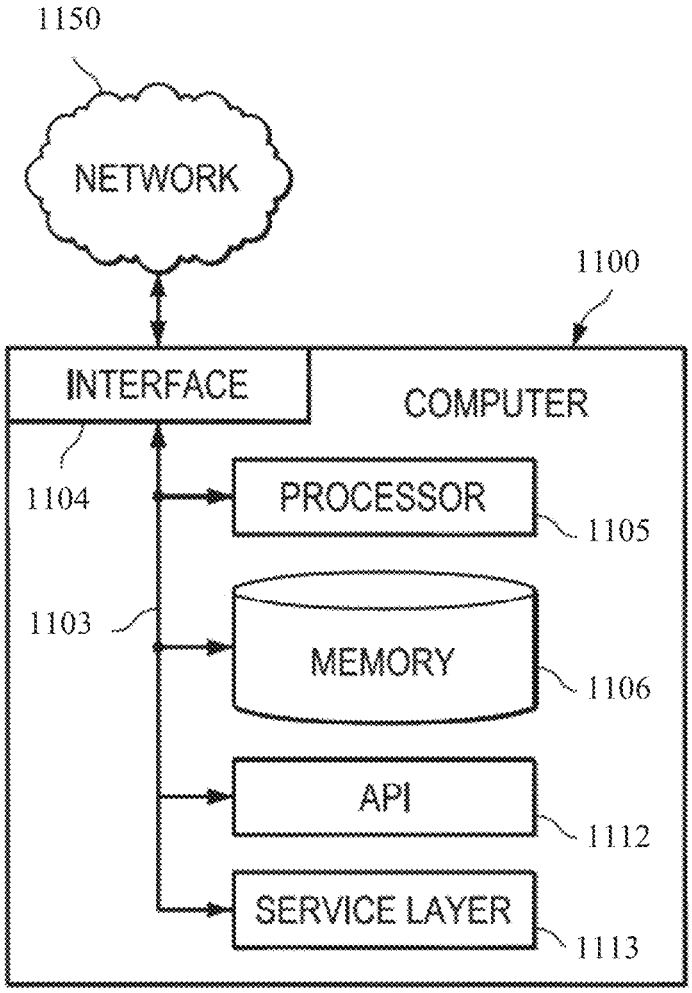
FIG. 11 is a high-level architecture block diagram of a computer system to model crossflow in the injection well.

FIG. 11 is a high-level architecture block diagram of a computer system 1100 to model crossflow in the injection well. At a high level, the computer system 1100 includes a flow response computer system 1100 that is communicably coupled with a network 1150. The network 1150 facilitates communications between the components of the system 1100 with other components. The computer system 1100 can receive requests over network 1150 from a client application and respond to the received requests by processing the requests in an appropriate software application. In addition, requests may also be sent to the computer system 1100 from internal users (for example, from a command console or by another appropriate access method), external or third parties, other automated applications, as well as any other appropriate entities, individuals, systems, or computers.

The computer system 1100 is configured to model cross-flow in the injection well. In some cases, the computer system 1100 is configured to implement the process 300 or the process 400 (or both) in an executable computing code, for example C/C++ executable codes, an application program, for example, EXCEL, or another other computer programs.

The computer system 1100 can include a computer that includes an input device, such as a keypad, keyboard, touch screen, microphone, speech recognition device, other device that can accept user information, or an output device that conveys information associated with the operation of the computer, including digital data, visual or audio information, or a GUI.

Each of the components of the computer system 1100 can communicate using a system bus 1103. In some implementations, any or all the components of the computer system 1100, both hardware or software, can interface with each other or the interface 1104 over the system bus 1103 using an application programming interface (API) 1112 or a service layer 1113.

The computer system 1100 includes an interface 1104. Although illustrated as a single interface 1104 in FIG. 11, two or more interfaces 1104 can be used according to particular needs, desires, or particular implementations of the computer system 1100. The interface 1104 is used by the computer system 1100 for communicating with other systems in a distributed environment connected to the network 1150 (whether illustrated or not).

The computer system 1100 includes one or more processors (for example, a processor 1105). Although illustrated as a single processor 1105 in FIG. 11, two or more processors can be used according to particular needs, desires, or particular implementations of the computer system 1100. Generally, the processor 1105 executes instructions and manipulates data to perform the operations described here.

The computer system 1100 also includes a memory 1106 that holds data for the computer system 1100. Although illustrated as a single memory 1106 in FIG. 11, two or more memories may be used according to particular needs, desires, or particular implementations of the computer system 1100. While memory 1106 is illustrated as an integral component of the computer system 1100, in alternative implementations, memory 1106 can be external to the computer system 1100.

Implementations of the subject matter and the operations described in this Specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method comprising:

during normal operation of an injection well formed in a subterranean zone, determining a plurality of bottomhole pressures at a bottom of the injection well based on a respective plurality of surface injection pressures at a surface of the injection well, each surface injection pressure being a pressure in the injection well resulting from a respective injection flow rate at which injection fluid is flowed through the injection well from the surface toward the bottom;

determining an injection well performance model for the injection well based on the plurality of bottomhole pressures and a plurality of injection flow rates, wherein each injection flow rate is caused by each surface injection pressure of the plurality of surface injection pressures;

after an injection well shut-in responsive to a subsurface leak in the injection well, wherein the leak causes a crossflow from a high pressure region in the subterranean zone to a comparatively low pressure region in another subterranean zone through the injection well:

modeling the shut-in injection well as an injection well having the injection well performance model determined during normal operation of the injection well;

modeling the shut-in injection well as a producing well having the injection well performance model determined during normal operation of the injection well; and determining a crossflow rate in the injection well at a location of the subsurface leak in the injection well based on the injection well performance model of the modeled injection well and the injection well performance model of the modeled producing well.

2. The method of claim 1, wherein modeling the shut-in injection well as the injection well having the injection well performance model determined during normal operation of the injection well comprises:

using the injection well performance model, determining an injectivity index for the injection well during normal operation of the injection well, wherein the injectivity index is a ratio between an injection flow rate of the injection fluid into the injection well and a difference between a downhole injection pressure resulting from the injection flow rate and a static bottomhole reservoir pressure; and assigning the injectivity index for the injection well as the injectivity index for the producing well.

3. The method of claim 2, wherein, using the injection well performance model, determining the injectivity index for the injection well during normal operation of the injection well comprises:

determining a plurality of injectivity indices based on the plurality of bottomhole pressures and a plurality of injection flow rates; and calibrating the plurality of injectivity indices to determine the injectivity index.

4. The method of claim 3, wherein calibrating the plurality of injectivity indices comprises performing a statistical regression analysis on the plurality of injectivity indices.

5. The method of claim 1, wherein determining the injection well performance model for the injection well based on the plurality of bottomhole pressures and the plurality of injection flow rates comprises determining a curve for the injection well performance model, wherein the curve represents a bottomhole pressure and an injection flow rate of the injection fluid into the injection well at the surface of the injection well.

6. The method of claim 5, wherein the bottomhole pressure in the curve is determined using the following equation:

$$Pdownhole\ inj. = P_{WH_{inj}} + \frac{\rho_w \sin\emptyset \times D}{144} - \left[\frac{f\rho_w Q^2}{14.79\ g_c\ d^5}\right],$$

where $P_{WH_{inj}}$ is the surface injection pressure measured for the injection flow rate, $\rho_w$ is the density of the injection fluid, Ø is a deviation angle of the injection well relative to a vertical axis, f is a dimensionless friction factor, $g_c$ is acceleration due to gravity, and d is an inside diameter of the injection well.

7. The method of claim 6, wherein the injection flow rate in the curve is determined using the following equation: Q=II (Pdownhole inj.−Pr), where II is an injectivity index of the injection well and Pr is a static bottomhole reservoir pressure of the injection well before the injection well shut-in.

8. The method of claim 2, wherein modeling the shut-in injection well as the injection well having the injection well performance model determined during normal operation of the injection well comprises assigning a bottomhole pressure of the modeled shut-in injection well to be the same as a bottomhole pressure of the injection well measured during normal operation.

9. The method of claim 1, wherein determining the crossflow rate in the injection well at the location of the subsurface leak in the injection well based on the injection well performance model of the modeled injection well and the injection well performance model of the modeled producing well comprises:

determining first flow injection pressures ($P_{wfl1}$) and corresponding first flow rates into the location ($Q_L$) for the modeled shut-in injection well using surface injection pressures and flow rates collected after the leak has developed in the actual injection well;

determining second flow injection pressures ($P_{wfl2}$) and corresponding second flow rates ($Q_{IP}$) from a downhole location in in the subterranean zone into the location of the subsurface leak for the modeled shut-in producing well; and determining an intersection of a plot of $P_{wfl1}$ versus $Q_L$ and $P_{wfl2}$ versus $Q_{IP}$.

10. The method of claim 9, wherein determining the second flow injection pressures and the corresponding second flow rates comprises:

assigning the location of the subsurface leak in the injection well as a top node of the modeled shut-in producing well; and determining a production flow rate for the modeled shut-in producing well at each bottomhole pressure of the plurality of bottomhole pressures based on which the injection well performance model was determined, wherein the production flow rate is determined using the following equation: Q=PI (Pr−Pwf), where Q is the production flow rate, PI is a productivity index of the producing well, Pr is a static bottomhole reservoir pressure of the injection well during normal operation and Pwf is a flowing bottomhole reservoir pressure of the modeled shut-in producing well at a selected node, being the subsurface leak depth, after the injection well shut-in responsive to a leak, wherein the productivity index is assigned the injectivity index of the injection well during normal operation.

11. The method of claim 1, wherein the injection fluid is water.

12. A non-transitory computer-readable medium storing instructions executable by one or more processors to perform operations comprising:

during normal operation of an injection well formed in a subterranean zone, receiving a plurality of bottomhole pressures at a bottom of the injection well based on a respective plurality of surface injection pressures at a surface of the injection well, each surface injection pressure being a pressure in the injection well resulting from a respective injection flow rate at which injection fluid is flowed through the injection well from the surface toward the bottom;

determining an injection well performance model for the injection well based on the plurality of bottomhole pressures and a plurality of injection flow rates, wherein each injection flow rate is caused by each surface injection pressure of the plurality of surface injection pressures;

after an injection well shut-in responsive to a subsurface leak in the injection well, wherein the leak causes a crossflow from a high pressure region in the subterranean zone to a comparatively low pressure region in another subterranean zone through the injection well:

modeling the shut-in injection well as an injection well having the injection well performance model determined during normal operation of the injection well;

modeling the shut-in injection well as a producing well having the injection well performance model determined during normal operation of the injection well; and determining a crossflow rate in the injection well at a location of the subsurface leak in the injection well based on the injection well performance model of the modeled injection well and the injection well performance model of the modeled producing well.

13. The medium of claim 12, wherein modeling the shut-in injection well as the injection well having the injection well performance model determined during normal operation of the injection well comprises:

using the injection well performance model, determining an injectivity index for the injection well during normal operation of the injection well, wherein the injectivity index is a ratio between an injection flow rate of the injection fluid into the injection well and a difference between a downhole injection pressure resulting from the injection flow rate and a static bottomhole reservoir pressure; and assigning the injectivity index for the injection well as the injectivity index for the producing well.

14. The medium of claim 13, wherein, using the injection well performance model, determining the injectivity index for the injection well during normal operation of the injection well comprises:

determining a plurality of injectivity indices based on the plurality of bottomhole pressures and a plurality of injection flow rates; and calibrating the plurality of injectivity indices to determine the injectivity index.

15. The medium of claim 14, wherein calibrating the plurality of injectivity indices comprises performing a statistical regression analysis on the plurality of injectivity indices.

16. The medium of claim 12, wherein determining the injection well performance model for the injection well based on the plurality of bottomhole pressures and the plurality of injection flow rates comprises determining a curve for the injection well performance model, wherein the curve represents a bottomhole pressure and an injection flow rate of the injection fluid into the injection well at the surface of the injection well.

17. The medium of claim 16, wherein the bottomhole pressure in the curve is determined using the following equation:

$$Pdownhole\ inj. = P_{WH_{inj}} + \frac{\rho_w \sin\emptyset \times D}{144} - \left[\frac{f\rho_w Q^2}{14.79\ g_c\ d^5}\right],$$

where $P_{WH_{inj}}$ is the surface injection pressure measured for the injection flow rate, $\rho_w$ is the density of the injection fluid, Ø is a deviation angle of the injection well relative to a vertical axis, f is a dimensionless friction factor, $g_c$ is acceleration due to gravity, and d is an inside diameter of the injection well.

18. The medium of claim 17, wherein the injection flow rate in the curve is determined using the following equation: Q=II (Pdownhole inj.−Pr), where II is an injectivity index of the injection well and Pr is a static bottomhole reservoir pressure of the injection well before the injection well shut-in.

19. The medium of claim 13, wherein modeling the shut-in injection well as the injection well having the injection well performance model determined during normal operation of the injection well comprises assigning a bottomhole pressure of the modeled shut-in injection well to be the same as a bottomhole pressure of the injection well measured during normal operation.

20. The medium of claim 12, wherein determining the crossflow rate in the injection well at the location of the subsurface leak in the injection well based on the injection well performance model model of the modeled injection well and the injection well performance model of the modeled producing well comprises:

determining first flow injection pressures ($P_{wfl1}$) and corresponding first flow rates into the location ($Q_L$) for the modeled shut-in injection well using surface injection pressures and flow rates collected after the leak has developed in the actual injection well;

determining second flow injection pressures ($P_{wfl2}$) and corresponding second flow rates ($Q_{IP}$) from a down-hole location in in the subterranean zone into the location of the subsurface leak for the modeled shut-in producing well; and determining an intersection of a plot of $P_{wfl1}$ versus $Q_L$ and $P_{wfl2}$ versus $Q_{IP}$.

* * * * *